US007988565B2

(12) United States Patent
Abe

(10) Patent No.: US 7,988,565 B2
(45) Date of Patent: Aug. 2, 2011

(54) GOLF CLUB HEAD

(75) Inventor: Hiroshi Abe, Kobe (JP)

(73) Assignee: SRI Sports Limited, Kobe (JP)

( * ) Notice: Subject to any disclaimer, the term of this patent is extended or adjusted under 35 U.S.C. 154(b) by 81 days.

(21) Appl. No.: 12/512,600

(22) Filed: Jul. 30, 2009

(65) Prior Publication Data

US 2010/0029408 A1 Feb. 4, 2010

(30) Foreign Application Priority Data

Jul. 31, 2008 (JP) ..... 2008-197587

(51) Int. Cl.
*A63B 53/04* (2006.01)

(52) U.S. Cl. ..... 473/328; 473/345; 473/346

(58) Field of Classification Search ..... 473/324–350, 473/287–292; D21/752
See application file for complete search history.

(56) References Cited

U.S. PATENT DOCUMENTS

| | | | | | |
|---|---|---|---|---|---|
| 2,041,676 | A * | 5/1936 | Gallagher | 473/327 |
| 3,997,170 | A * | 12/1976 | Goldberg | 473/327 |
| 5,257,786 | A * | 11/1993 | Gorman | 473/349 |
| 5,292,129 | A * | 3/1994 | Long et al. | 473/346 |
| D351,441 | S * | 10/1994 | Iinuma et al. | D21/752 |
| 5,441,263 | A * | 8/1995 | Gorman | 473/349 |
| D363,749 | S * | 10/1995 | Kenmi | D21/752 |
| 5,456,469 | A * | 10/1995 | MacDougall | 473/328 |
| D366,684 | S * | 1/1996 | Lin | D21/752 |
| 5,735,754 | A * | 4/1998 | Antonious | 473/328 |
| 6,422,951 | B1 * | 7/2002 | Burrows | 473/328 |
| 6,595,871 | B2 * | 7/2003 | Sano | 473/342 |
| 6,663,503 | B1 * | 12/2003 | Kenmi | 473/328 |
| 6,676,535 | B2 * | 1/2004 | Sheets et al. | 473/328 |
| 7,273,419 | B2 * | 9/2007 | Evans et al. | 473/328 |
| 7,273,423 | B2 * | 9/2007 | Imamoto | 473/332 |
| 7,500,924 | B2 * | 3/2009 | Yokota | 473/332 |
| 7,572,193 | B2 * | 8/2009 | Yokota | 473/328 |
| D624,979 | S * | 10/2010 | Morris et al. | D21/752 |
| 2003/0114244 | A1 * | 6/2003 | Matsunaga | 473/345 |
| 2006/0172818 | A1 | 8/2006 | Yamamoto | |
| 2007/0149310 | A1 * | 6/2007 | Bennett et al. | 473/328 |
| 2010/0062875 | A1 * | 3/2010 | Hoffman et al. | 473/346 |

FOREIGN PATENT DOCUMENTS

| | | |
|---|---|---|
| JP | 2005-95247 A | 4/2005 |
| JP | 2006-204604 A | 8/2006 |
| JP | 2008-86351 A | 4/2008 |

* cited by examiner

*Primary Examiner* — Sebastiano Passaniti
(74) *Attorney, Agent, or Firm* — Birch, Stewart, Kolasch & Birch, LLP

(57) ABSTRACT

A head 2 is hollow. The head 2 has a sole part 8. The sole part 8 has a groove forming part k1 having a recessed outer surface g1 and a protruding inner surface s1. The sole part 8 has a first groove forming part k1 and a second groove forming part k1. The first groove forming part k1 and the second groove forming part k1 have a front-back directional length. A distance between the first groove forming part k1 and the second groove forming part k1 in a toe-heel direction is wider toward a back of the head. Preferably, the first groove forming part k1 and the second groove forming part k1 exist on a back of a face surface 13. Preferably, the sole part 8 has a connecting groove part r1. The connecting groove part r1 is formed by connecting a front end of the first groove forming part k1 to a front end of the second groove forming part k1 with each other.

20 Claims, 10 Drawing Sheets

GOLF CLUB HEAD

The present application claims priorities on Japanese Patent Application No. 2008-197587 filed on Jul. 31, 2008. The whole contents of the Japanese Patent Application are hereby incorporated by reference.

BACKGROUND OF THE INVENTION

1. Field of the Invention

The present invention relates to a hollow golf club head.

2. Description of the Related Art

A hollow golf club head has been known. The hollow structure increases a head volume and a moment of inertia. A so-called wood type golf club head is usually hollow.

The volume of a hollow part is increased and the thickness of the head is thinned with the increase in size of the head. The head increased in size causes a loud hitting sound.

Golf club heads for obtaining a good hitting sound have been disclosed. As the inventions considering a hitting sound, Japanese Unexamined Patent Application Publication No. 2006-204604 (US2006-172818 A1), Japanese Unexamined Patent Application Publication No. 2008-86351, and Japanese Unexamined Patent Application Publication No. 2005-95247. Japanese Unexamined Patent Application Publication No. 2006-204604 discloses a head having a sole and a rib provided on the inner surface of the sole. The rib has a toe side end and a heel side end which are curved toward a face side relative to a central region.

SUMMARY OF THE INVENTION

The hollow golf club head with a great volume has a drawback that a hitting sound is excessively lowered. A higher hitting sound is preferable in order to obtain a good hitting sound. When the rib is provided on the inner surface of the sole, the rigidity of the sole increases and the hitting sound is high. However, in this case, the increase in the weight of the head is caused by the existence of the rib.

It is possible to form a groove on an outer surface of the sole and to form a protruding part at a position on the reverse side of the groove on the inner surface of the sole. The constitution can suppress the increase in the weight and enhance the rigidity of the sole. The enhancement of the rigidity of the sole can improve the hitting sound. However, in this case, stress concentrates on the groove or the protruding part on the reverse side thereof, and the durability is apt to be deteriorated.

It is an object of the present invention to provide a golf club head capable of attaining the improvement of the hitting sound and the enhancement of the durability while suppressing the increase in the weight.

A golf club head according to the present invention has a sole part. The sole part has a groove forming part having a recessed outer surface and a protruding inner surface. The sole part has a first groove forming part and a second groove forming part. The first groove forming part and the second groove forming part have a front-back directional length. A distance between the first groove forming part and the second groove forming part in a toe-heel direction is wider toward a back of the head. The golf club head is hollow.

Preferably, the first groove forming part and the second groove forming part exist on a back of a face surface.

Preferably, the sole part has a connecting groove part formed by connecting a front end of the first groove forming part and a front end of the second groove forming part with each other.

Preferably, a first connecting groove part is provided on a toe side relative to a center section plane of the head, and a second connecting groove part is provided on a heel side relative to the center section plane of the head.

Preferably, a ratio [ta/tb] of a thickness ta (mm) of the groove forming part to an average thickness tb (mm) of the sole part excluding the groove forming part is 1.0 or greater and 2.0 or less.

Preferably, the first groove forming part and the second groove forming part which are adjacent to each other exist.

Preferably, a plurality of sets consisting of the first groove forming part and the second groove forming part exist.

Preferably, an angle θa between an extending direction of the first groove forming part and an extending direction of the second groove forming part adjacent to the first groove forming part is 5 degrees or greater and 60 degrees or less.

Preferably, an angle θt between the groove forming part located closest to a toe side and a front-back direction is 10 degrees or greater and 60 degrees or less; and an angle θh between the groove forming part located closest to a heel side and the front-back direction is 10 degrees or greater and 60 degrees or less.

Preferably, an absolute value of an angle θ1 between an extending direction of the groove forming part nearest to a center section plane and a front-back direction is 5 degrees or greater and 30 degrees or less.

Preferably, an angle θ2 between an extending direction of the groove forming part farthest from a center section plane and a front-back direction is 10 degrees or greater and 60 degrees or less.

Preferably, an angle θ3 between an extending direction of the groove forming part located closest to a toe side and an extending direction of the groove forming part located closest to a heel side is 20 degrees or greater 120 degrees or less.

Preferably, a straight line Lx connects a point on the groove forming part located closest to a front and a point on the groove forming part located closest to a back with each other; and a ratio [m1/L1] of a maximum distance m1 (mm) between a point existing on the groove forming part and the straight line Lx to a length L1 (mm) of the straight line Lx is equal to or less than 0.5.

Preferably, a height H1 (mm) of a protruding part on an inner surface side of the groove forming part is 0.1 mm or greater and 3 mm or less.

Preferably, a difference (H1−D1) between a height H1 (mm) of a protruding part on an inner surface side of the groove forming part and a groove depth D1 (mm) on an outer surface side of the groove forming part is 0.1 mm or greater and 2 mm or less.

Preferably, a groove Mt other than the groove forming part is formed on the sole part; and the groove Mt and the groove forming part are not crossed with each other.

Preferably, a length Lk1 of the groove forming part is 30 mm or greater and 150 mm or less.

Preferably, a difference [Lk11−Lk12] between a length Lk11 (mm) of the groove forming part nearest to a center section plane on a toe side than the center section plane and a length Lk12 (mm) of the groove forming part farthest from the center section plane on the toe side than the center section plane is 5 mm or greater and 80 mm or less.

Preferably, a difference [Lk11−Lk12] between a length Lk11 (mm) of the groove forming part nearest to a center section plane on a heel side than the center section plane and a length Lk12 (mm) of the groove forming part farthest from the center section plane on the heel side than the center section plane is 5 mm or greater and 80 mm or less.

Preferably, a length Lr of the connecting groove part is 100 mm or greater and 200 mm or less.

Preferably, a volume of the head is 350 cc or greater and 460 cc or less.

Preferably, a weight of the head is 170 g or greater and 220 g or less.

DESCRIPTION OF THE PREFERRED EMBODIMENTS

Hereinafter, the present invention will be described in detail according to the preferred embodiments with appropriate references to the accompanying drawings.

Figure 1:
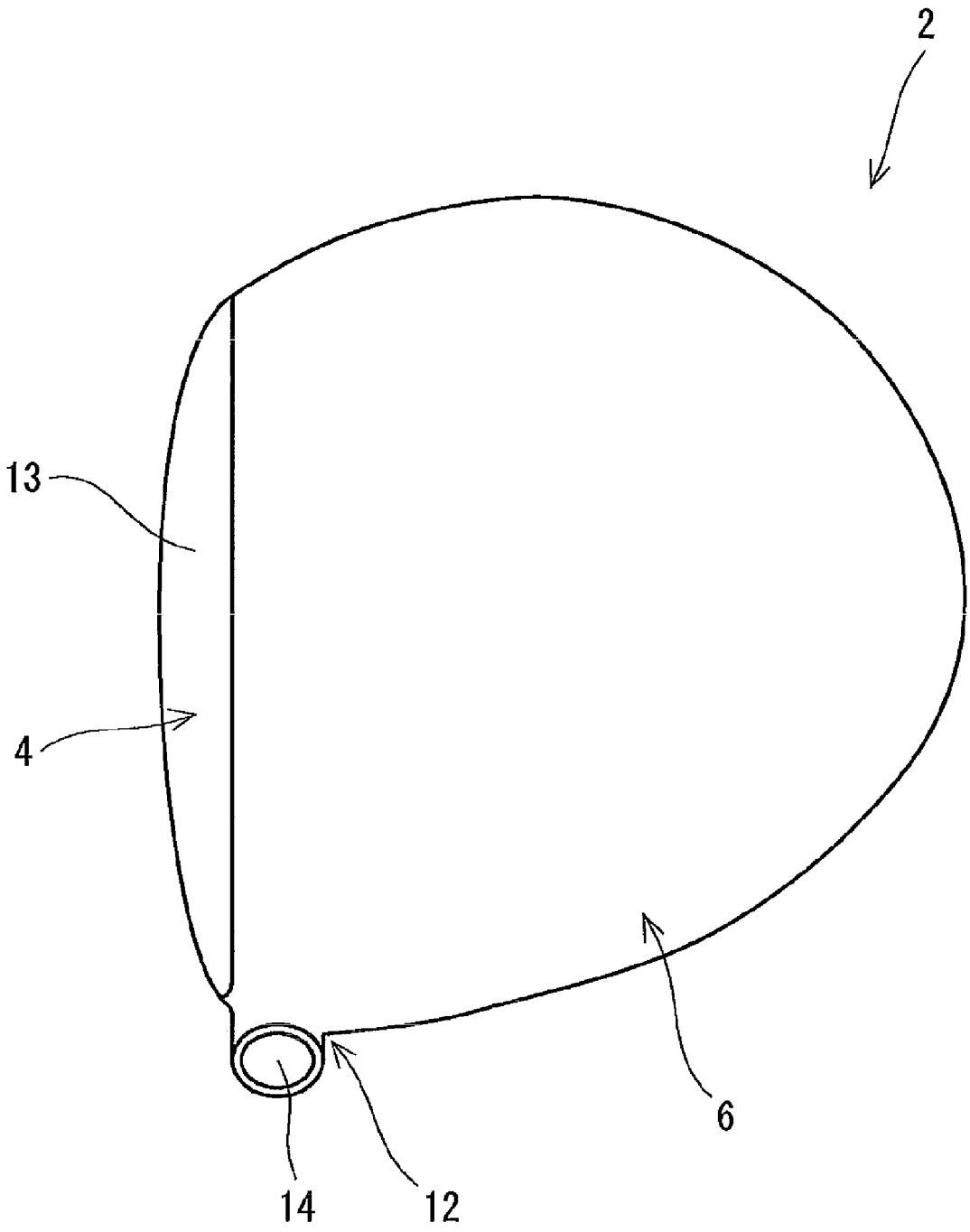
FIG. 1 is a view of a golf club head according to an embodiment of the present invention as seen from a crown side.
Figure 2:
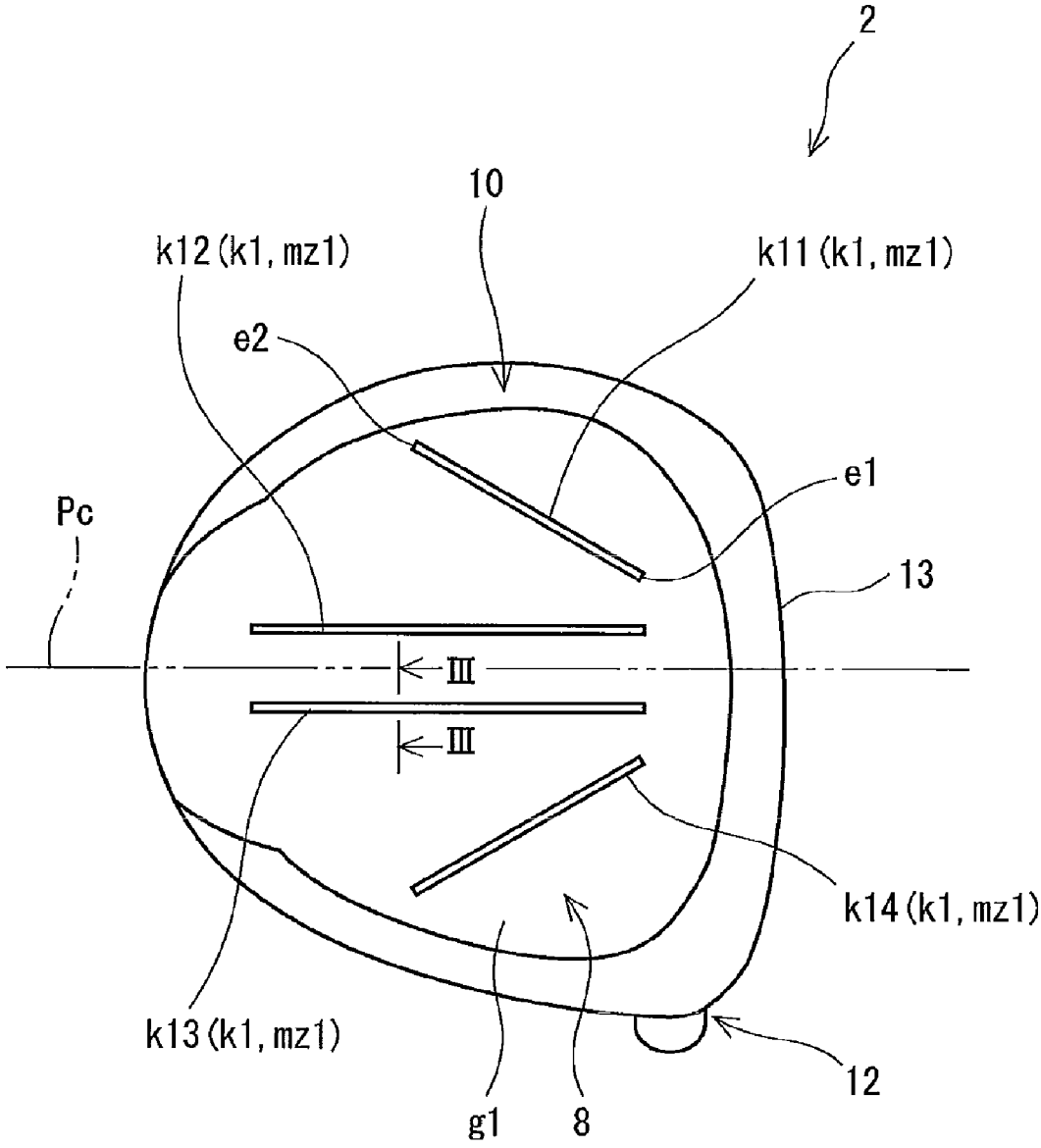
FIG. 2 is a view of the head of FIG. 1 as seen from a sole side, FIG. 2 substantially equal to a projected image Te to be described later.
Figure 3:
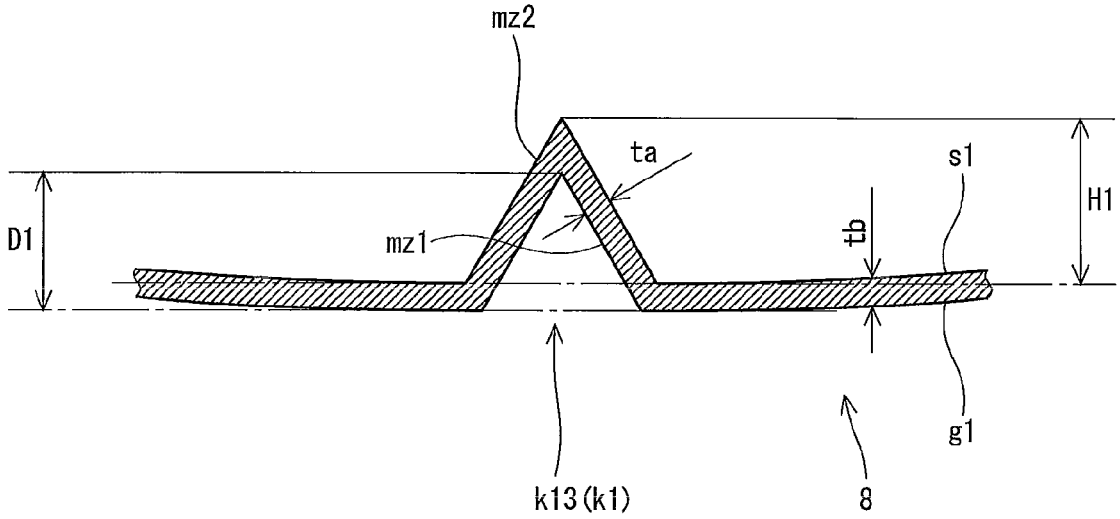
FIG. 3 is a cross sectional view taken along a line III-III in FIG. 2.
Figure 4:
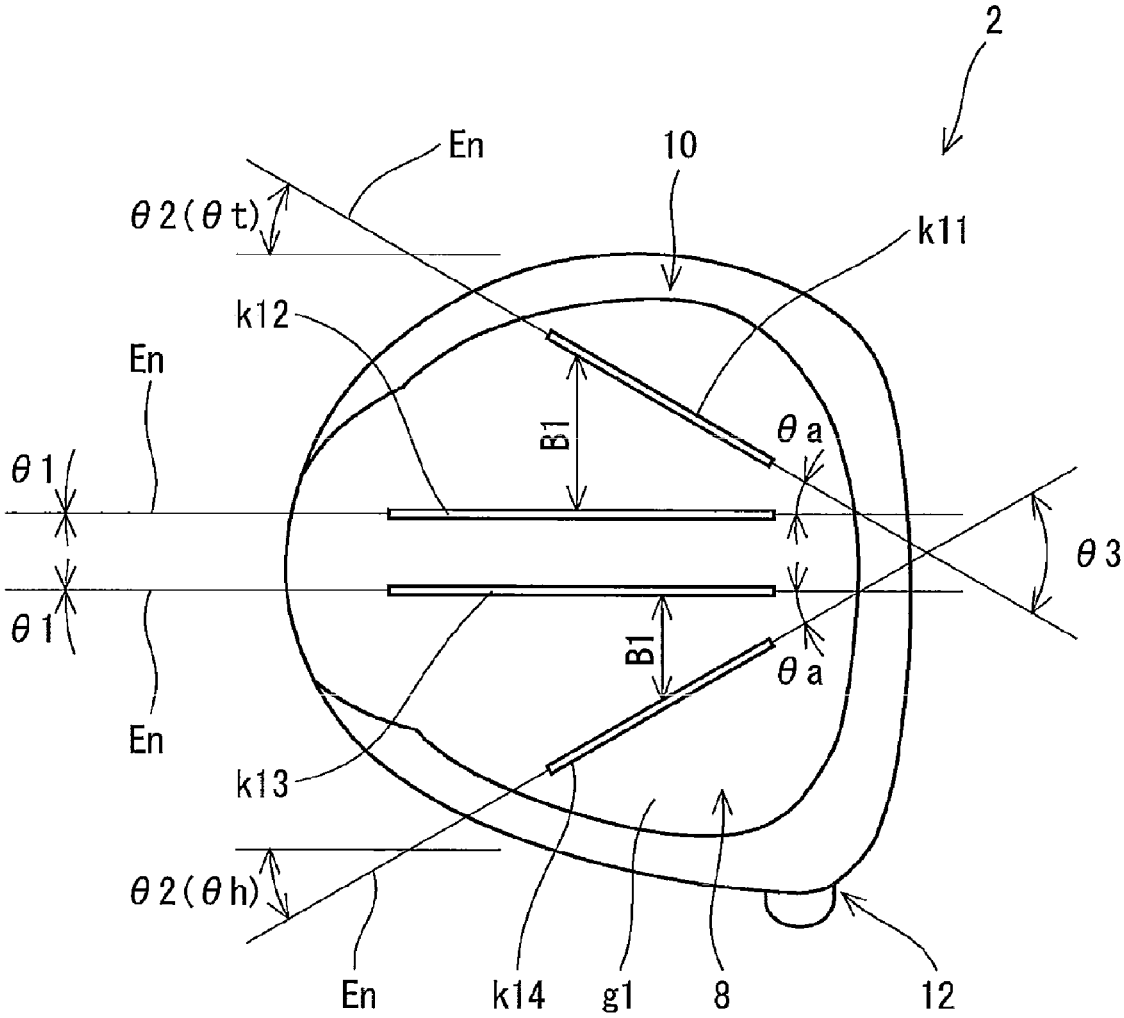
FIG. 4 is a view of the head of FIG. 1 as seen from the sole side.

FIG. 1 is a view of a golf club head 2 according to one embodiment of the present invention as seen from a crown side. FIG. 2 is a view of the head 2 as seen from a sole side. FIG. 3 is a cross sectional view of a sole part taken along a line III-III in FIG. 2. FIG. 4 is a view of the head 2 as seen from the sole side as in FIG. 2. FIG. 4 is shown in addition to FIG. 2 in order to prevent a large number of reference numerals and auxiliary lines from concentrating.

The head 2 has a face part 4, a crown part 6, a sole part 8, a side part 10, and a hosel part 12. The outer surface of the face part 4 is a face surface 13. The crown part 6 extends toward the backside of the head from the upper edge of the face part 4. The sole part 8 extends toward the backside of the head from the lower edge of the face part 4. The side part 10 extends between the crown part 6 and the sole part 8. As shown in FIG. 4, the inside of the head 2 is hollow. The head 2 is a hollow golf club head. The head 2 is a so-called wood type golf club head.

The hosel part 12 has a hole 14 to which a shaft is mounted. The shaft (not shown) is inserted into the hole 14. The hole 14 has a centeral axial line Z1 (not shown). The centeral axial line Z1 generally conforms to a shaft axial line of a golf club provided with the head 2.

In the present invention, a standard perpendicular plane, a front-back direction, a toe-heel direction and a standard projection plane are defined. A standard condition denotes a state that the centeral axial line Z1 is contained in a plane P1 perpendicular to a horizontal plane H and the head is placed on the horizontal plane H at a prescribed lie angle and real loft angle. In the standard condition, the standard vertical plane denotes the plane P1. In the standard condition, the horizontal plane H is the standard projection plane.

In the present application, the toe-heel direction is a direction of line of intersection between the standard perpendicular plane and the horizontal plane H. In the present application, the front-back direction is a direction perpendicular to the toe-heel direction and parallel to the horizontal plane H.

In the present application, "front" and "front side" are judged on the basis of the front-back direction. In the present application, "back" and "back side" are judged on the basis of the front-back direction. In the present application, "toe side" is judged on the basis of the toe-heel direction. In the present application, "heel side" is judged on the basis of the toe-heel direction.

A plurality of grooves mz1 are provided on an outer surface g1 of the sole part 8. Four grooves mz1 are provided on the sole part 8 of the head 2. Recesses are formed on the outer surface g1 of the sole part 8 by the grooves mz1.

As shown in FIG. 3, protruding parts mz2 are formed at positions corresponding to the grooves mz1 on an inner surface s1 of the sole part 8. The cross sectional shape of the groove mz1 is an approximately V shape. The cross sectional shape of the protruding part mz2 is an approximately V shape. The cross sectional shape of the groove mz1 and the cross sectional shape of the protruding part mz2 are approximately equal.

The cross sectional shape of the groove mz1 is not limited. A rectangle and a semicircle or the like are exemplified as the cross sectional shape of the groove mz1. The cross sectional shape of the protruding part mz2 is not limited. A rectangle and a semicircle or the like are exemplified as the cross sectional shape of the protruding part mz2.

The protruding parts mz2 linearly extend on the inner surface s1 of the sole part 8 (not shown). The protruding part mz2 extend along the groove mz1 on the reverse side of the groove mz1 (not shown).

The sole part 8 has a groove forming part k1 having a recessed outer surface g1 and a protruding inner surface s1. A plurality of groove forming parts k1 are provided. In the head 2, four groove forming parts k1 are provided. The outer surface of the groove forming part k1 forms the groove mz1. The inner surface of the groove forming part k1 forms the protruding part mz2.

All the groove forming parts k1 do not reach the face surface 13. All the groove forming parts k1 terminate without reaching the face surface 13. All the groove forming parts k1 exist on a back of the face surface 13. Since the groove forming parts k1 do not reach the face surface 13, the groove forming parts k1 are less likely to be subjected to impact at the time of hitting a ball. Therefore, load on the groove forming parts k1 can be reduced and the durability of the head 2 can be enhanced.

As shown in FIG. 3, a thickness ta (mm) of the groove forming part k1 is approximately equal to an average thickness tb (mm) of the sole part 8 excluding the groove forming part k1. In light of hitting sound improving effect and the durability of the groove forming part k1, [ta/tb] is preferably equal to or greater than 1.0, more preferably equal to or greater than 1.1, and still more preferably equal to or greater than 1.2. In light of the durability of the sole part 8 and of the suppression of the increase in the weight, [ta/tb] is preferably equal to or less than 2.0, and more preferably equal to or less than 1.5.

The head 2 has a groove forming part k11, a groove forming part k12, a groove forming part k13 and a groove forming part k14 as the groove forming part k1. The cross sectional shapes of all the groove forming parts k1 are common. The groove forming part k11 is not parallel to the toe-heel direction. Therefore, the groove forming part k11 has a front-back directional length. Similarly, the groove forming part k12 has the front-back directional length. The groove forming part k13 has the front-back directional length. The groove forming part k14 has the front-back directional length.

The groove forming part k1 has a front end e1 and a back end e2. All the groove forming parts k1 have the front end e1 and the back end e2.

The groove forming part k11 extends linearly. The groove forming part k12 extends linearly. The groove forming part k13 extends linearly. The groove forming part k14 extends linearly.

In the present invention, the sole part 8 has a first groove forming part and a second groove forming part. One of the plurality of groove forming parts k1 is the first groove forming part. The other one of the plurality of groove forming parts k1 is the second groove forming part. Any of the plurality of groove forming parts k1 may be the first groove forming part. Any of the plurality of groove forming parts k1 may be the second groove forming part. All the groove forming parts excluding the first groove forming part may be the second groove forming part.

In the head 2, for example, the groove forming part k11 is the first groove forming part. In the head 2, for example, the groove forming part k12 is the second groove forming part. As shown in FIG. 2, a distance B1 between the first groove forming part (groove forming part k11) and the second groove forming part (groove forming part k12) in the toe-heel direction is wider toward a back of the head (see FIG. 4). That is, the distance B1 is narrower toward the front of the head.

In the head 2, for example, the groove forming part k13 is the second groove forming part. In the head 2, for example, the groove forming part k14 is the first groove forming part. As shown in FIG. 2, a distance B1 between the first groove forming part (groove forming part k14) and the second groove forming part (groove forming part k13) in the toe-heel direction is wider toward the back of the head (see FIG. 4). That is, the distance B1 is narrower toward a front of the head.

The first groove forming part and the second groove forming part are preferably adjacent to each other. That is, the first groove forming part k1 and the second groove forming part k1 are preferably selected so as that another groove forming part does not exist between the first groove forming part and the second groove forming part. For example, in the embodiment of FIG. 4, the groove forming part k11 located closest to a toe side may be defined as the first groove forming part k1, and the groove forming part k14 located closest to a heel side may be defined as the second groove forming part k1. The distance B1 between the first groove forming part k11 and the second groove forming part k14 in the toe-heel direction is wider toward the back of the head. When the plurality of groove forming parts k1 exist on the toe side relative to a center section plane Pc, one of the groove forming parts k1 on the toe side relative to a center section plane Pc is preferably defined as the first groove forming part, and one of the groove forming parts k1 on the toe side relative to a center section plane Pc is defined as the second groove forming part. When the plurality of groove forming parts k1 exist on the heel side relative to the center section plane Pc, one of the groove forming parts k1 on the heel side relative to a center section plane Pc is preferably defined as the first groove forming part, and one of the groove forming parts k1 on the heel side relative to a center section plane Pc is preferably defined as the second groove forming part.

In the head 2, a plurality of sets (two sets) consisting of the first groove forming part k1 and the second groove forming part k1 exist.

In FIG. 2, a plane Pc passing through the center of gravity of the head, including a front-back directional line and being perpendicular to the horizontal plane H in the head of the standard condition is shown by a dashed-two dotted line. The plane Pc is the center section plane in the present application.

In the head 2, the plurality of groove forming parts k1 exist on the toe side relative to the center section plane Pc. In the head 2, the groove forming part k11 and the groove forming part k12 exist on the toe side relative to the center section plane Pc. In the head 2, the first groove forming part and the second groove forming part exist on the toe side relative to the center section plane Pc.

In the head 2, the plurality of groove forming parts k1 exist on the heel side relative to the center section plane Pc. In the head 2, the groove forming part k13 and the groove forming part k14 exist on the heel side relative to the center section plane Pc. In the head 2, the first groove forming part and the second groove forming part exist on the heel side relative to the center section plane Pc.

In the head 2, the plurality of groove forming parts k1 existing on the toe side relative to the center section plane Pc, and the plurality of groove forming parts k1 existing on the heel side relative to the center section plane Pc exist. In this case, for example, in a region on the toe side relative to the center section plane Pc, the groove forming part k1 farthest from the center section plane Pc is defined as the first groove forming part, and the groove forming part k1 nearest to the center section plane Pc is defined as the second groove forming part. In this case, for example, in a region of the heel side relative to the center section plane Pc, the groove forming part k1 farthest from the center section plane Pc is defined as the first groove forming part, and the groove forming part k1 nearest to the center section plane Pc is defined as the second groove forming part.

In the head 2, in the region of the toe side relative to the center section plane Pc, the distance B1 between the first groove forming part k11 and the second groove forming part k12 in the toe-heel direction is wider toward the back of the head.

In the head 2, in the region of the heel side relative to the center section plane Pc, the distance B1 between the first groove forming part k14 and the second groove forming part k13 in the toe-heel direction is wider toward the back of the head.

Great stress is apt to act on a portion near the face surface. The distance B1 is narrower toward the face surface, and thereby the rigidity of the sole can be efficiently enhanced. The distance B1 is wider toward the back, and thereby the stress acting on the groove forming part k1 can be efficiently dispersed. Therefore, the distance B1 is wider toward the back of the head, and thereby the rigidity of the head can be efficiently enhanced. The distance B1 is wider toward the back of the head, and thereby the load on the bottom of the groove can be reduced and the durability can be enhanced. From this viewpoint, preferably, the sole part does not have a portion in which the distance between the groove forming parts in the toe-heel direction is narrower toward the back of the head.

Figure 5:
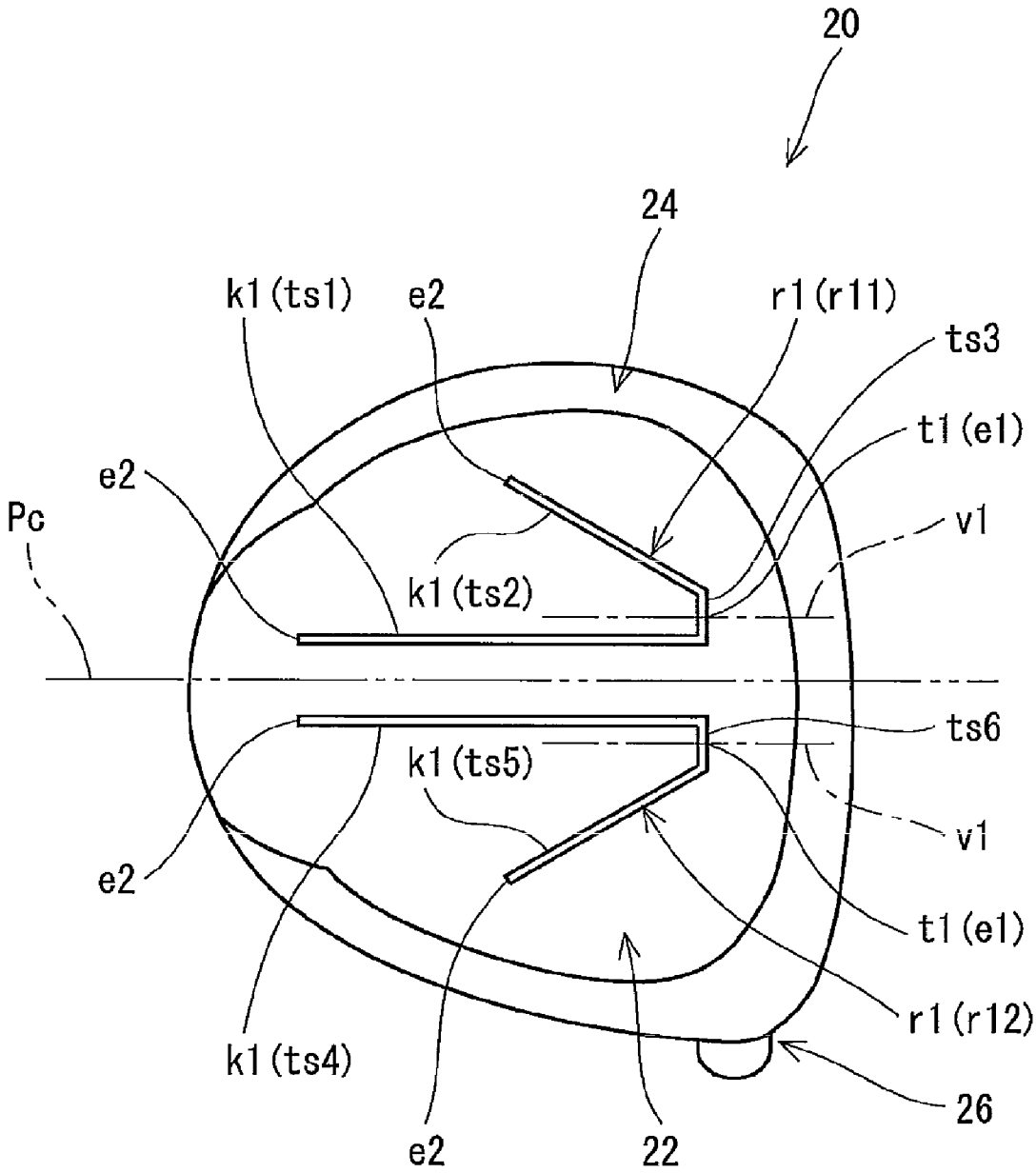
FIG. 5 is a view of a head according to a second embodiment as seen from a sole side, FIG. 5 substantially equal to the projected image Te.
Figure 6:
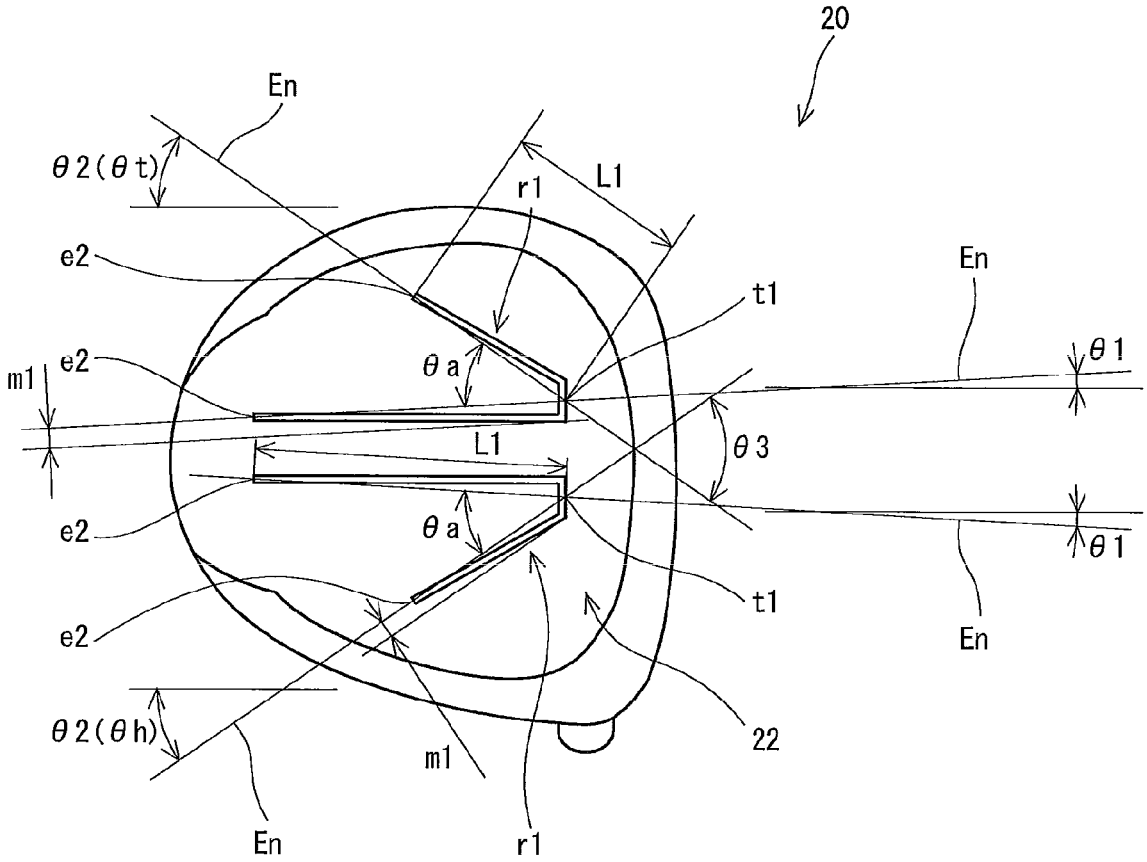
FIG. 6 is the view of the head according to the second embodiment as seen from the sole side.

FIGS. 5 and 6 are views of a head 20 according to a second embodiment as seen from a sole side. The head 20 has a face part (not shown), a crown part (not shown), a sole part 22, a side part 24, and a hosel part 26. The head 20 is the same as the head 2 except for the arrangement of groove forming parts k1.

The sole part 22 has connecting groove parts r1. Two connecting groove parts r1 are formed on the sole part 22.

The connecting groove part r1 is bent. The connecting groove part r1 extends toward the front from one end thereof, is folded, extends toward the back, and extends to the other end thereof.

The connecting groove part r1 is formed by connecting a plurality (two) of groove forming parts k1. In the present application, one connecting groove part r1 is considered to be formed by connecting two groove forming parts k1 with each other. The connecting groove part r1 is formed by connecting a front end e1 of the first groove forming part k1 and a front end e1 of the second groove forming part k1 with each other.

As shown in FIG. 5, a first connecting groove part r11 is provided on a toe side relative to a center section plane Pc. A second connecting groove part r12 is provided on a heel side relative to the center section plane Pc. A first connecting groove part r1 is provided on the toe side relative to the center of the head 20 in a toe-heel direction. A second connecting groove part r1 is provided on the heel side relative to the center of the head 20 in the toe-heel direction.

As shown in FIG. 5, the first connecting groove part r11 has a first straight line part ts1, a second straight line part ts2, and a third straight line part ts3. In a projected image Te to be described later, the first straight line part ts1, the second straight line part ts2, and the third straight line part ts3 extends straightly. The first straight line part ts1 extends approximately along a front-back direction. The second straight line part ts2 extends so as that the back side thereof is closer to the toe side. The third straight line part ts3 connects a front end of the first straight line part ts1 to a front end of the second straight line part ts2. The third straight line part ts3 extends approximately along the toe-heel direction. All the extending directions of the connecting groove parts are judged in the projected image Te to be described later. The first straight line part ts1, the second straight line part ts2 and the third straight line part ts3 extends linearly. However, these may extend curvedly.

The second connecting groove part r12 has a first straight line part ts4, a second straight line part ts5 and a third straight line part ts6. In the projected image Te, the first straight line part ts4, the second straight line part ts5 and the third straight line part ts6 extend straightly. The first straight line part ts4 extends approximately along the front-back direction. The second straight line part ts5 extends so as that the back side thereof is closer to the heel side. The third straight line part ts6 connects a front end of the first straight line part ts4 to a front end of the second straight line part ts5 with each other. The third straight line part ts6 extends approximately along the toe-heel direction. All the extending directions of the connecting groove parts are judged in the projected image Te to be described later. The first straight line part ts4, the second straight line part ts5 and the third straight line part ts6 extends linearly. However, these may extend curvedly.

The connecting groove part r1 is divided into the first groove forming part k1 and the second groove forming part k1. The division is carried out by a division line v1. The division line v1 is a straight line which extends in the front-back direction and passes through a dividing point t1. The dividing point t1 is a forefront point of the connecting groove part r1. That is, the dividing point t1 is a point located closest to the front in the connecting groove part r1. The term "front" is a front in the front-back direction. When a plurality of points sp1 located closest to the front exist, a central point cs1 between a forefront point sp1 closest to the toe side and a forefront point sp1 closest to the heel side in the toe-heel direction is defined as the dividing point t1. When the central point cs1 does not exist on the connecting groove part r1, a straight line Ls1 passing through the central point cs1 and extending in the front-back direction is considered, and a point on the straight line Ls1 may be defined as the dividing point t1. In this case, the straight line Ls1 agrees to the division line v1. The division line v1 is a virtual line. The division line v1 is drawn in the projected image Te. The dividing point t1 is determined in the projected image Te.

In the present application, the extending directions of the groove forming parts and all the angles relating to the groove forming parts are judged in the projected image Te.

The front end e1 of the first groove forming part k1 exists on the division line v1. The front end e1 of the second groove forming part k1 also exists on the division line v1.

Thus, the connecting groove part r1 is divided into the first groove forming part k1 and the second groove forming part k1 by the division line v1.

Figure 7:
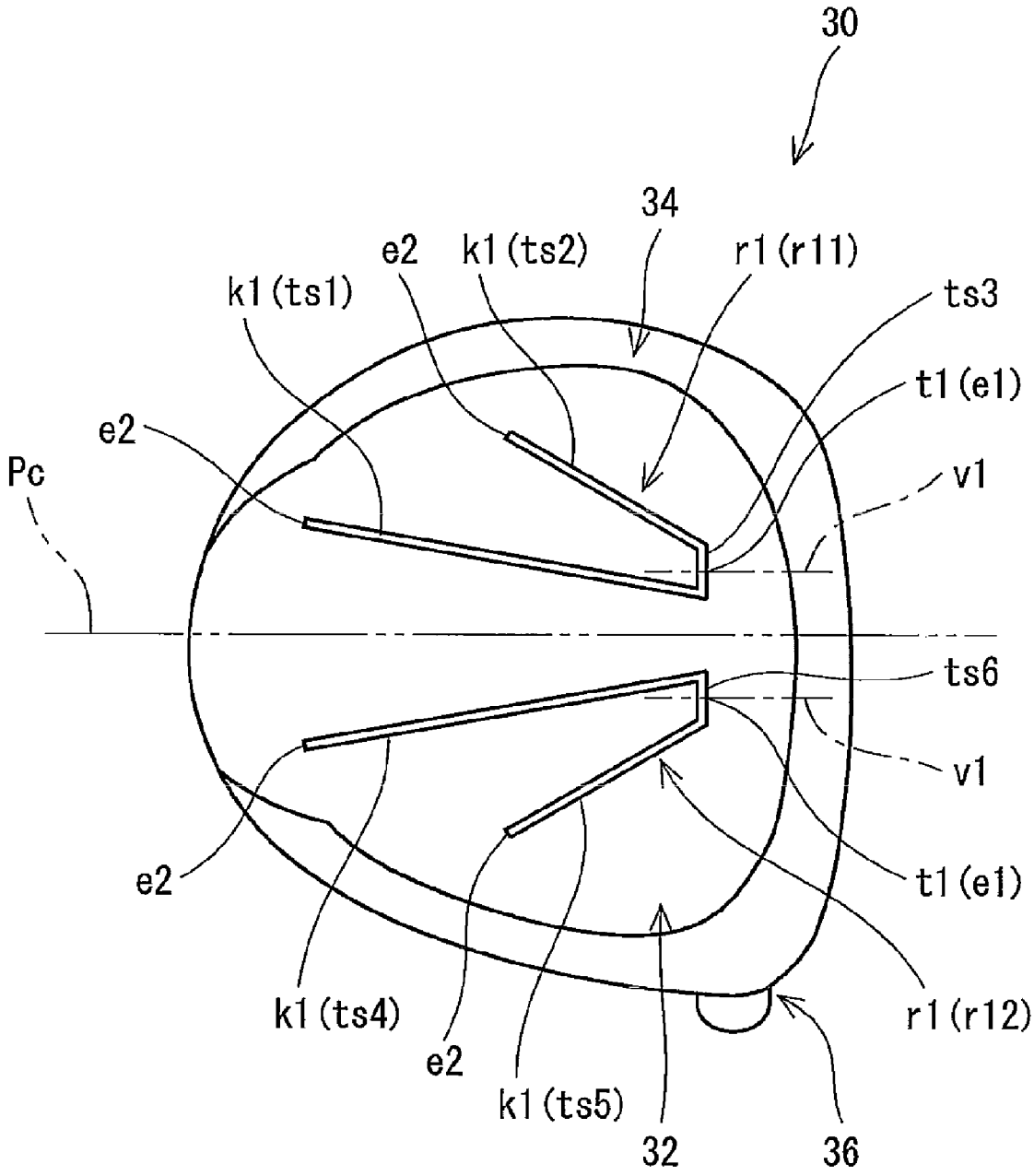
FIG. 7 is a view of a head according to a third embodiment as seen from a sole side, FIG. 7 substantially equal to the projected image Te.
Figure 8:
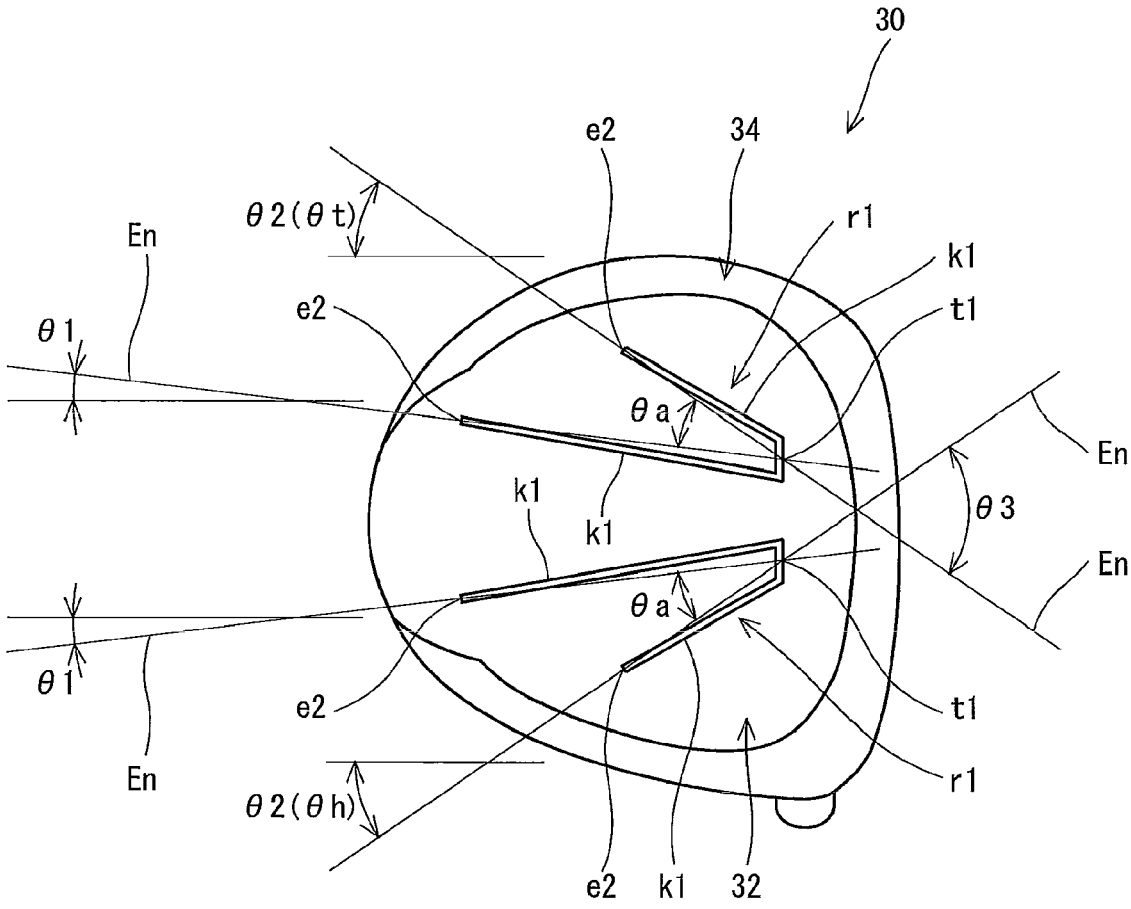
FIG. 8 is the view of the head according to the third embodiment as seen from the sole side.

FIGS. 7 and 8 are views of a head 30 according to a third embodiment as seen from a sole side. The head 30 has a face part (not shown), a crown part (not shown), a sole part 32, a side part 34 and a hosel part 36. The head 30 is the same as the head 2 except for the arrangement of groove forming parts k1.

The sole part 32 has connecting groove parts r1. Two connecting groove parts r1 are provided on the sole part 32. A first connecting groove part r11 is provided on a toe side relative to a center section plane Pc. A second connecting groove part r12 is provided on a heel side relative to the center section plane Pc. A first connecting groove part r1 is provided on the toe side relative to the center of the head 30 in a toe-heel direction. A second connecting groove part r1 is provided on the heel side relative to the center of the head 30 in the toe-heel direction.

The first connecting groove part r11 has a first straight line part ts1, a second straight line part ts2, and a third straight line part ts3. In a projected image Te, the first straight line part ts1, the second straight line part ts2, and the third straight line part ts3 extends straightly. The first straight line part ts1 extends so as that the back side thereof is closer to the toe side. The second straight line part ts2 extends so as that the back side thereof is closer to the toe side. A distance between the first straight line part ts1 and the second straight line part ts2 in the toe-heel direction is wider toward the back side. The third straight line part ts3 connects a front end of the first straight line part ts1 to a front end of the second straight line part ts2. The third straight line part ts3 extends approximately along the toe-heel direction. All the extending directions of the connecting groove parts are judged in the projected image Te to be described later. The first straight line part ts1, the second straight line part ts2 and the third straight line part ts3 extend linearly. However, these may extend curvedly.

The second connecting groove part r12 has a first straight line part ts4, a second straight line part ts5 and a third straight line part ts6. In the projected image Te, the first straight line part ts4, the second straight line part ts5 and the third straight line part ts6 extend straightly. The first straight line part ts4 extends so as that the back side thereof is closer to the toe side. The second straight line part ts5 extends so as that the back side thereof is closer to the heel side. A distance between the first straight line part ts4 and the second straight line part ts5 in the toe-heel direction is wider toward the back side. The third straight line part ts6 connects a front end of the first straight line part ts4 to a front end of the second straight line part ts5. The third straight line part ts6 extends approximately along the toe-heel direction. All the extending directions of the connecting groove parts are judged in the projected image Te to be described later. The first straight line part ts4, the second straight line part ts5 and the third straight line part ts6 extend linearly. However, these may extend curvedly.

The connecting groove part r1 is bent. The connecting groove part r1 extends toward the front side from one end thereof, is folded, extends toward the back side, and extends to the other end thereof.

The connecting groove part r1 is formed by connecting a plurality (two) of groove forming parts k1 with each other. In the present application, one connecting groove part r1 is considered to be formed by connecting two groove forming parts k1 with each other. The connecting groove part r1 is formed by connecting a front end e1 of the first groove forming part k1 and a front end e1 of the second groove forming part k1 with each other.

The front end e1 of the first groove forming part k1 exists on the division line v1. The front end e1 of the second groove forming part k1 also exists on the division line v1. The connecting groove part r1 is divided into the first groove forming part k1 and the second groove forming part k1 by the division line v1.

In the head 20 and the head 30, the distance of each of all the connecting groove parts r1 in the toe-heel direction is wider toward the back. That is, in each of the connecting groove parts r1, the distance between the first groove forming part k1 and the second groove forming part k1 in the toe-heel direction is wider toward the back side.

In the present application, the extending directions of the groove forming parts and all the angles relating to the groove forming parts are judged in the projected image Te. All the angles shown in FIGS. 4, 6 and 8 are angles in the projected image Te.

Examples of the angles described in FIGS. 4, 6 and 8 include an angle θa, an angle θt, an angle θh, an angle θ1, an angle θ2 and an angle θ3.

The double-pointed arrow θa shown in FIGS. 4, 6 and 8 is an angle between the extending direction of the first groove forming part k1 and the extending direction of the second groove forming part k1 adjacent to the first groove forming part k1. Preferably, the angle θa is an angle formed by two groove forming parts k1 disposed on the toe side relative to the center section plane Pc. Alternatively, preferably, the angle θa is an angle formed by two groove forming parts k1 disposed on the heel side relative to the center section plane Pc. The rigidity of the sole part is effectively enhanced by enlarging the angle θa, and thereby the improving effect of the hitting sound can be obtained. When the angle θa is small, two groove forming parts k1 are nearly in parallel with each other, and stress concentration is apt to occur in the bottom of the groove. The stress concentration is apt to deteriorate the durability. From these viewpoints, the angle θa is preferably equal to or greater than 5 degrees, more preferably equal to or greater than 10 degrees, and still more preferably equal to or greater than 20 degrees. When the extending direction of the groove forming part is close to the toe-heel direction, the groove forming part is apt to be curved by impact caused at the time of hitting a ball. When the deformation of the groove forming part is great, the durability of the groove forming part is apt to be deteriorated. From this viewpoint, the angle θa is preferably equal to or less than 60 degrees, more preferably equal to or less than 50 degrees, and still more preferably equal to or less than 40 degrees, and particularly preferably equal to or less than 30 degrees.

The double-pointed arrow θt shown in FIGS. 4, 6 and 8 is an angle between the groove forming part k1 located closest to the toe side and the front-back direction. In light of hitting sound improving effect and durability, the angle θt is preferably equal to or greater than 10 degrees, more preferably equal to or greater than 15 degrees, still more preferably equal to or greater than 20 degrees, and particularly preferably equal to or greater than 30 degrees. In light of suppressing the deformation of the groove forming part to enhance the durability, the angle θt is preferably equal to or less than 60 degrees, more preferably equal to or less than 50 degrees, and still more preferably equal to or less than 40 degrees.

The double-pointed arrow θh shown in FIGS. 4, 6 and 8 is an angle between the groove forming part k1 located closest to the heel side and the front-back direction. In light of the hitting sound improving effect and the durability, the angle θh is preferably equal to or greater than 10 degrees, more preferably equal to or greater than 15 degrees, still more preferably equal to or greater than 20 degrees, and particularly preferably equal to or greater than 30 degrees. In light of suppressing the deformation of the groove forming part to enhance the durability, the angle θh is preferably equal to or less than 60 degrees, more preferably equal to or less than 50 degrees, and still more preferably equal to or less than 40 degrees.

The double-pointed arrow θ1 shown in FIGS. 6 and 8 is an angle between the extending direction of the groove forming part k1 closest to the center section plane Pc and the front-back direction when the head is divided by the center section plane Pc. The angle θ1 may be 0 degree. In light of alleviating the stress concentration in the face side end part of the groove forming part k1, the absolute value of the angle θ1 is preferably equal to or greater than 5 degrees, and more preferably equal to or greater than 10 degrees. In light of the groove forming part k1 closest to the center section plane Pc among the groove forming parts k1 located on the toe side relative to the center section plane Pc, and the groove forming part k1 closest to the center section plane Pc among the groove forming parts k1 located on the heel side relative to the center section plane Pc being separated as approaching the back side of the head, the angle θ1 is preferably equal to or greater than 5 degrees, and preferably equal to or greater than 10 degrees. When the angle θ1 is excessively great, the stress concentration is apt to occur in the bottom of the groove. When the angle θ1 is excessively great, an angle θ2 to be described later is easily set to a preferable value. From this viewpoint, the angle θ1 is preferably equal to or less than 30 degrees, more preferably equal to or less than 20 degrees, and still more preferably equal to or less than 15 degrees. In light of efficiently enhancing the rigidity of the sole part, the extending direction of the groove forming part k1 near the center section plane Pc is preferably inclined so as that the back thereof is away from the center section plane Pc when the head is divided by the center section plane Pc.

When the extending direction of the groove forming part k1 is separated from the center section plane Pc as approaching the back side, the angle θ1 is defined as a plus value. On the other hand, when the extending direction of the groove forming part k1 is separated from the center section plane Pc as approaching the front side, the angle θ1 is defined as a minus value. In the embodiment of FIG. 6, both the angles θ1 of two positions are minus. In the embodiment of FIG. 8, both the angles θ1 of two positions are plus. Referring to the angle θh and the angle θt, plus and minus are defined as well as the angle θ1. In the embodiment of FIG. 4, the angle θh is plus and the angle θt is also plus.

The double-pointed arrow θ2 shown in FIGS. 6 and 8 is an angle between the extending direction of the groove forming part k1 farthest from the center section plane Pc and the front-back direction when the head is divided by the center section plane Pc. In light of setting the angle θ1 to a preferable value, the angle θ2 is preferably equal to or greater than 10 degrees, more preferably equal to or greater than 15 degrees, still more preferably equal to or greater than 20 degrees, and particularly preferably equal to or greater than 30 degrees. In light of suppressing the deformation of the groove forming part to enhance the durability, the angle θ2 is preferably equal to or less than 60 degrees, more preferably equal to or less than 50 degrees, and still more preferably equal to or less than 40 degrees. In light of efficiently enhancing the rigidity of the sole part to improve the hitting sound, the extending direction of the groove forming part k1 far from the center section plane Pc is preferably inclined so as that the back side thereof is away from the center section plane Pc when the head is divided by the center section plane Pc.

When the extending direction of the groove forming part k1 is separated from the center section plane Pc as approaching the back side, the angle θ2 is defined as a plus value. On the other hand, when the extending direction of the groove forming part k1 is separated from the center section plane Pc as approaching the front side, the angle θ2 is defined as a minus value. In the embodiments of FIGS. 6 and 8, both the angles θ2 of two positions are plus.

The double-pointed arrow θ3 shown in FIGS. 4, 6 and 8 is an angle between the extending direction of the groove forming part k1 located closest to the toe side and the extending direction of the groove forming part k1 located closest to the heel side. In light of efficiently enhancing the rigidity of the sole part to improve the hitting sound, the angle θ3 is preferably equal to or greater than 20 degrees, more preferably equal to or greater than 30 degrees, still more preferably equal to or greater than 40 degrees, and particularly preferably equal to or greater than 60 degrees. In light of suppressing the deformation of the groove forming part to enhance the durability, the angle θ3 is preferably equal to or less than 120 degrees, more preferably equal to or less than 100 degrees, and still more preferably equal to or less than 80 degrees.

In the embodiment of FIG. 6 and the embodiment of FIG. 8, the groove forming parts k1 are bent. An extending direction En of the groove forming part k1 is defined as follows, including the case where the groove forming parts k1 are bent. In the projected image Te, a straight line Lx which connects a point on the groove forming part k1 located closest to the front side and a point on the groove forming part k1 located closest to the back side with each other is defined. The direction of the straight line Lx is the extending direction En. When the connecting groove part r1 is formed by connecting the groove forming parts k1, a straight line which connects a point located closest to the back and a dividing point t1 with each other is the straight line Lx. The direction of this straight line Lx is the extending direction En. The straight line Lx is contained in a straight line drawn as the extending direction En in FIGS. 4, 6 and 8.

A maximum distance between a point which exists on the groove forming part k1 and the straight line Lx is shown by a double-pointed arrow m1 in FIG. 6. A length (mm) of the straight line Lx is shown by a double-pointed arrow L1 in FIG. 6. The distance m1 and the length L1 are determined in the projected image Te. When the groove forming parts k1 are bent, the distance m1 (mm) is greater than 0. In light of further enhancing effects relating to the angles (angle θ1, angle θ2, angle θ3, angle θa, angle θt, and angle θh), a ratio [m1/L1] of the distance m1 to the length L1 is considered. The effects relating to the angles can be enhanced with the smaller ratio [m1/L1] when the groove forming parts r1 are bent. From this viewpoint, the ratio [m1/L1] is preferably equal to or less than 0.5, more preferably equal to or less than 0.3, and still more preferably equal to or less than 0.1.

A depth (mm) of a groove on the outer surface side of the groove forming part is shown by a double-pointed arrow D1 in FIG. 3. In light of enhancing the hitting sound improving effect, the depth D1 is preferably equal to or greater than 0.1 mm, more preferably equal to or greater than 0.3 mm, and still more preferably equal to or greater than 0.5 mm. In light of the durability of the groove forming part, the depth D1 is preferably equal to or less than 3 mm, more preferably equal to or less than 2 mm, and still more preferably equal to or less than 1 mm.

A height (mm) of the protruding part on the inner surface side of the groove forming part is shown by a double-pointed arrow H1 in FIG. 3. In light of enhancing the hitting sound improving effect, the height H1 is preferably equal to or greater than 0.1 mm, more preferably equal to or greater than 0.3 mm, and still more preferably equal to or greater than 0.5 mm. In light of the durability of the groove forming part, the height H1 is preferably equal to or less than 3 mm, more preferably equal to or less than 2 mm, and still more preferably equal to or less than 1 mm.

In light of the durability and the hitting sound improving effect, the thickness of the groove forming part is preferably greater than that of the sole part around the groove forming part. From this viewpoint, the height H1 is preferably greater than the depth D1. Specifically, a difference (H1−D1) between H1 and D1 is preferably equal to or greater than 0.1 mm. In light of suppressing the increase in the weight, the difference (H1−D1) is preferably equal to or less than 2 mm, more preferably equal to or less than 1 mm, and still more preferably equal to or less than 0.5 mm.

A groove Mt (not shown) other than the groove forming part may be formed on the sole part. Preferably, the groove forming part and the groove Mt are not crossed with each other. When the groove forming part and the groove Mt are crossed with each other, cracks or the like are apt to be created in the crossing portion. In the same viewpoint, preferably, the groove forming parts are not crossed with each other.

A length Lk1 (not shown) of the groove forming part is not limited. In light of the hitting sound improving effect, the length Lk1 is preferably equal to or greater than 30 mm, more preferably equal to or greater than 40 mm, still more preferably equal to or greater than 50 mm, and particularly preferably equal to or greater than 70 mm. In light of the durability of the groove forming part and of the suppression of the weight of the head, the length Lk1 is preferably equal to or less than 150 mm, more preferably equal to or less than 120 mm, and still more preferably equal to or less than 100 mm. When the groove forming parts are bent, the length Lk1 is measured along the bent direction. When the connecting groove part is provided, the length Lk1 is a length between the division line v1 and the back end of the groove forming part.

The central part of the sole part is apt to vibrate as compared with the peripheral part of the sole part. The hitting sound is likely to be more effectively improved by providing the groove forming part on the central part of the sole part. From this viewpoint, a length Lk11 (mm) of the groove forming part closest to the center section plane Pc on the toe side relative to the center section plane Pc is preferably longer than a length Lk12 (mm) of the groove forming part farthest from the center section plane Pc on the toe side relative to the center section plane Pc. Similarly, the length Lk11 of the groove forming part closest to the center section plane Pc on the heel side relative to the center section plane Pc is preferably longer than the length Lk12 of the groove forming part farthest from the center section plane Pc on the heel side relative to the center section plane Pc. Specifically, a difference [Lk11−Lk12] is preferably equal to or greater than 5 mm, more preferably equal to or greater than 10 mm, and still more preferably equal to or greater than 20 mm. When the length Lk12 is excessively short, the hitting sound improving effect may be deteriorated. From this viewpoint, the difference [Lk11−Lk12] is preferably equal to or less than 80 mm, more preferably equal to or less than 60 mm, and still more preferably equal to or less than 40 mm.

A length Lr (not shown) of the connecting groove part is not limited. In light of the hitting sound improving effect, the length Lr is preferably equal to or greater than 100 mm, more preferably equal to or greater than 120 mm, still more preferably equal to or greater than 130 mm. In light of the durability of the connecting groove part and of the suppression of the weight of the head, the length Lr is preferably equal to or less than 200 mm, more preferably equal to or less than 180 mm, and still more preferably equal to or less than 160 mm. When the connecting groove part is bent, the length Lr is measured along the bent direction.

When the volume of the head is great, the thickness of the head is apt to be thinned. Since the rigidity of the head is low when the thickness of the head is thin, the effects of the present invention obtained by the groove forming part are high. From this viewpoint, the volume of the head is preferably equal to or greater than 350 cc, more preferably equal to or greater than 380 cc, and still more preferably equal to or greater than 400 cc. In light of being compliant with the Golf Rules, the volume of the head is preferably equal to or less than 460 cc.

In light of a great moment of inertia enhancing the directionality of the ball, the weight of the head is preferably equal to or greater than 170 g, more preferably equal to or greater than 180 g, and still more preferably equal to or greater than 190 g. In light of obtaining the golf club which having an optimum club balance and being easily swung, the weight of the head is preferably equal to or less than 220 g, and more preferably equal to or less than 210 g.

The material for the head is not limited. As the material for the head, metal and CFRP (Carbon Fiber Reinforced Plastic) or the like are exemplified. As the metal used for the head, one or more kinds of metals selected from pure titanium, a titanium alloy, stainless steel, maraging steel, an aluminium alloy, Zr metal glass, carbon steel, Fe—Al—Mn alloy, a magnesium alloy and a tungsten-nickel alloy are exemplified. As the titanium alloy, 6-4 titanium (Ti-6Al-4V) and Ti-15V-3Cr-3Sn-3Al or the like are exemplified.

A method for manufacturing the head is not particularly limited. Usually, a hollow head is manufactured by bonding two or more members. A method for manufacturing the members constituting the head is not limited. As the method, casting, forging and press forming are exemplified. In casting, lost wax precision casting is preferable.

Examples of the structures of the heads include a two-piece structure in which two members integrally formed respectively are bonded, a three-piece structure in which three members integrally formed respectively are bonded, and a four-piece structure in which four members integrally formed respectively are bonded.

The following items are exemplified as the method for manufacturing the head.

(1) A head obtained by bonding a head body made of stainless steel and formed by casting, and a face member made of a titanium alloy by brazing.
(2) A head obtained by bonding a head body made of stainless steel and formed by casting, a face member made of a titanium alloy, and a crown member made of a titanium alloy by brazing.
(3) A head obtained by bonding a head body made of stainless steel and formed by casting, and a face member made of maraging steel by welding.
(4) A head obtained by bonding a head body made of stainless steel and formed by casting, and a crown member made of a carbon fiber reinforced plastic by an adhesive.
(5) A head obtained by bonding a head body made of stainless steel and formed by casting, and a crown member made of a magnesium alloy by an adhesive.
(6) A head obtained by bonding a head body made of a titanium alloy and formed by casting, and a face member made of a titanium alloy by welding.
(7) A head obtained by bonding a head body made of a titanium alloy and formed by casting, a face member made of a titanium alloy, and a crown member made of a titanium alloy by welding.
(8) A head obtained by welding a head body made of a titanium alloy and formed by casting and a face member made of a titanium alloy, and further bonding the head body and a crown member made of a carbon fiber reinforced plastic by an adhesive.
(9) A head obtained by welding a head body made of a titanium alloy and formed by casting and a face member made of a titanium alloy, and further bonding the head body and a crown member made of a magnesium alloy by an adhesive.
(10) A head obtained by bonding a head body made of a titanium alloy and formed by casting, and a face member made of a magnesium alloy by an adhesive.
(11) A head obtained by bonding a head body made of a titanium alloy and formed by casting, and a crown member made of a carbon fiber reinforced plastic by an adhesive. A plate-shaped face member and a cup-shaped face member are exemplified as the form of the face member.

EXAMPLES

Hereinafter, the effects of the present invention will be clarified by Examples. However, the present invention should not be interpreted in a limited way based on the description of Examples.

Example 1

A head having the same structure as that of the head 2 was produced. The configuration of a groove forming part as shown in FIG. 2 was used. A head body was obtained by subjecting a titanium alloy (Ti-6Al-4V) to lost-wax precision casting. A face member was obtained by forging a titanium alloy (Ti-15V-3Cr-3Sn-3Al). The head body and the face member were welded, and the outer surface of the head was ground to obtain the head. The volume of the head was 460 cc. The weight of the head was 185 g.

An angle θa formed by two groove forming parts located on a toe side relative to a center section plane Pc was set to 30 degrees. An angle θa formed by two groove forming parts located on a heel side relative to the center section plane Pc was set to 30 degrees. Both angles θ1 of two positions were set to 0 degree. Both angles θ2 of two positions were set to 30 degrees. A shaft and a grip were mounted to the head to obtain a golf club according to Example 1. The specifications and evaluation results of Example 1 are shown in the following Table 1. The meanings of the reference characters shown in Table 1 are the same as those of the above-mentioned numerals.

Example 2

A head and a golf club according to Example 2 were obtained in the same manner as in Example 1 except that the configuration of a groove forming part as shown in FIGS. 5 and 6 was used and that the weight of a head was set to 187 g. The specifications and evaluation results of Example 2 are shown in the following Table 1.

In Example 2, an angle θa formed by two groove forming parts located on a toe side relative to a center section plane Pc was set to 30 degrees. An angle θa formed by two groove forming parts located on a heel side relative to the center section plane Pc was also set to 30 degrees. Both angles θ1 of two positions were set to −5 degrees. Both angles θ2 of two positions were set to 25 degrees.

Example 3

A head and a golf club according to Example 3 were obtained in the same manner as in Example 1 except that the configuration of a groove forming part as shown in FIGS. 7 and 8 was used and that the weight of a head was set to 187 g. The specifications and evaluation results of Example 3 are shown in the following Table 1.

In Example 3, an angle θa formed by two groove forming parts located on a toe side relative to a center section plane Pc was set to 20 degrees. An angle θa formed by two groove forming parts located on a heel side relative to the center section plane Pc was also set to 20 degrees. Both angles θ1 of two positions were set to 10 degrees. Both angles θ2 of two positions were set to 30 degrees.

Comparative Example 1

Figure 9:
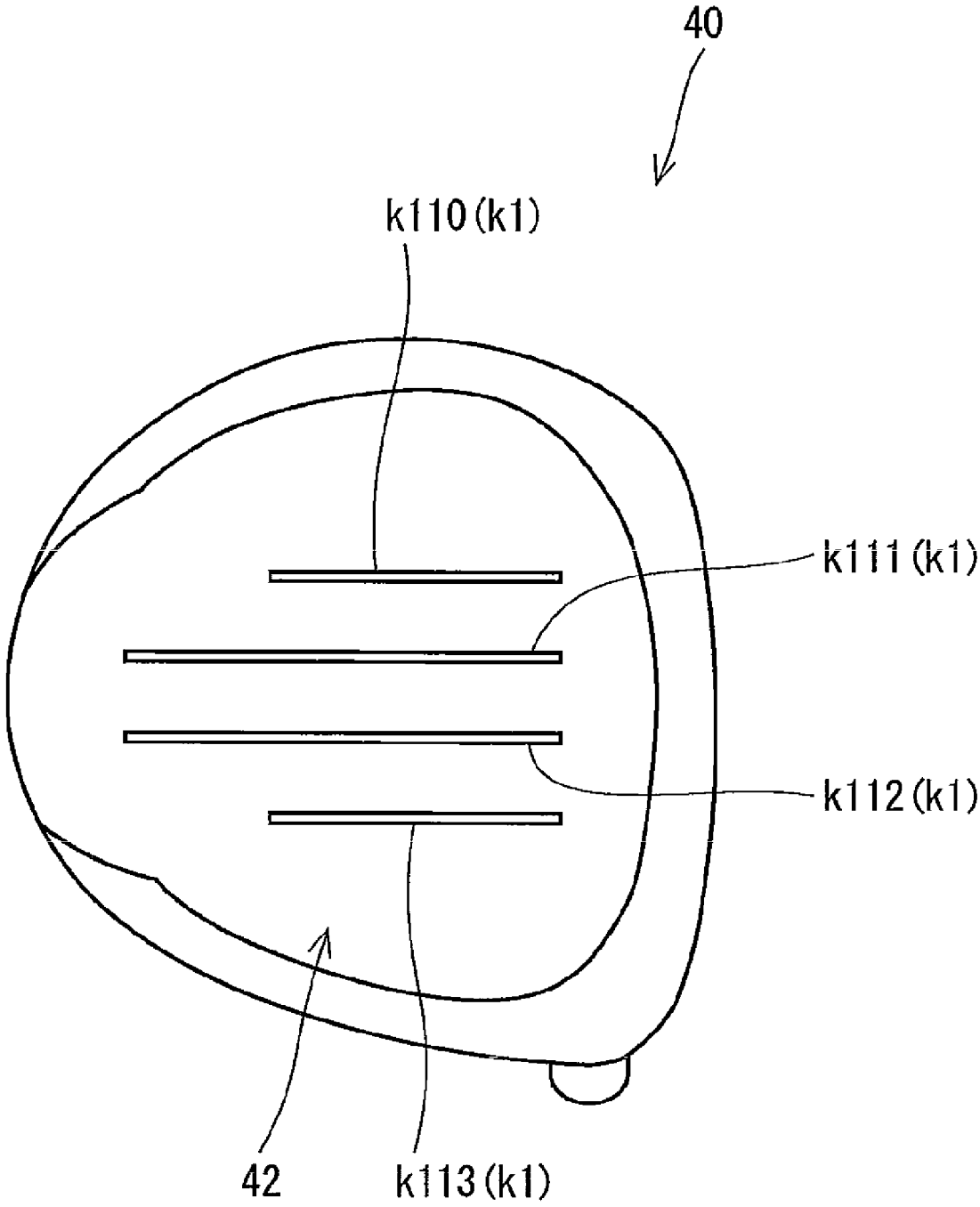
FIG. 9 is a view of a head of Comparative Example 1 as seen from a sole side.

A head and a golf club according to Comparative Example 1 were obtained in the same manner as in Example 1 except that the configuration of a groove forming part as shown in FIG. 9 was used and that the weight of a head was set to 190 g. The specifications and evaluation results of Comparative Example 1 are shown in the following Table 1.

As shown in FIG. 9, a head 40 of Comparative Example 1 has four groove forming parts k1. The four groove forming parts k1 are disposed at regular intervals in a toe-heel direction. The head 40 has a groove forming part k110, a groove forming part k111, a groove forming part k112 and a groove forming part k113. In a projected image Te, the groove forming part k110 extends in a front-back direction. In the projected image Te, the groove forming part k111 extends in the front-back direction. In the projected image Te, the groove forming part k112 extends in the front-back direction. In the projected image Te, the groove forming part k113 extends in the front-back direction. The two groove forming parts k1 (the groove forming part k111 and the groove forming part k112) near a center section plane Pc (not shown) are longer than the other two groove forming parts k1 (k110, k113). The length of the groove forming part k110 was set to 60 mm. The length of the groove forming part k111 was set to 90 mm. The length of the groove forming part k112 was set to 90 mm. The length of the groove forming part k113 was set to 60 mm.

Comparative Example 2

Figure 10:
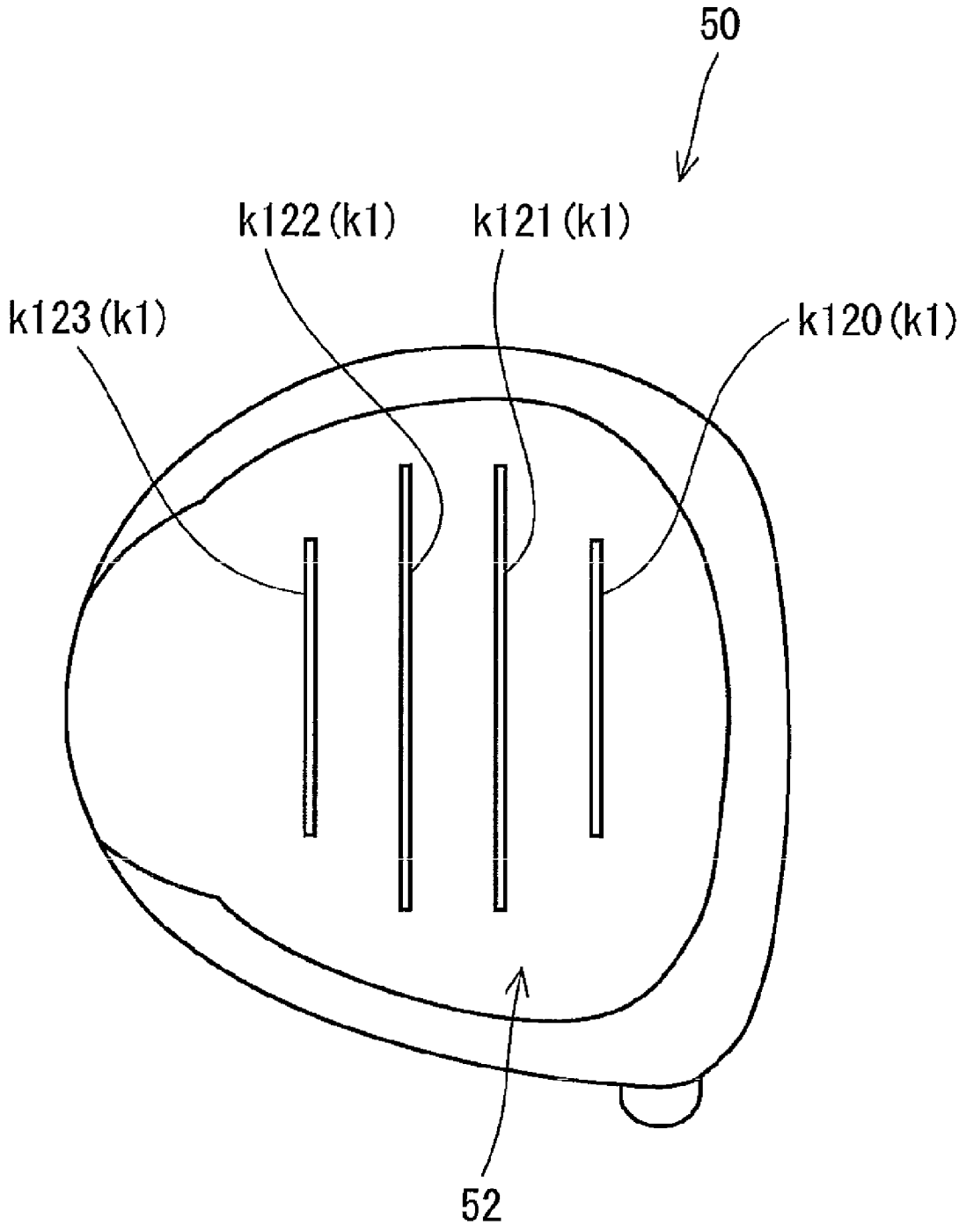
FIG. 10 is a view of a head of Comparative Example 2 as seen from a sole side.

A head and a golf club according to Comparative Example 2 were obtained in the same manner as in Example 1 except that the configuration of a groove forming part as shown in FIG. 10 was used and that the weight of a head was set to 190 g. The specifications and evaluation results of Comparative Example 2 are shown in the following Table 1.

As shown in FIG. 10, a head 50 of Comparative Example 2 has four groove forming parts k1. The four groove forming parts k1 are disposed at regular intervals in a toe-heel direction. The head 50 has a groove forming part k120, a groove forming part k121, a groove forming part k122 and a groove forming part k123. In the projected image Te, the groove forming part k120 extends in a toe-heel direction. In the projected image Te, the groove forming part k121 extends in the toe-heel direction. In the projected image Te, the groove forming part k122 extends in the toe-heel direction. In the projected image Te, the groove forming part k123 extends in the toe-heel direction. The length of the groove forming part k120 located closest to the front is equal to that of the groove forming part k123 located closest to the back. The length of the groove forming part k121 is equal to that of the groove forming part k122. The groove forming part k120 and the groove forming part k123 are shorter than the groove forming part k121 and the groove forming part k122. That is, the length of each of the two groove forming parts k1 disposed outside is shorter than the length of each of the two groove forming parts k1 disposed inside. The length of the groove forming part k120 was set to 60 mm. The length of the groove forming part k121 was set to 90 mm. The length of the groove forming part k122 was set to 90 mm. The length of the groove forming part k123 was set to 60 mm.

[Evaluation of Hitting Sound]

Each of ten golf players hit 10 golf balls with each of the golf clubs, and the hitting sound of each of the golf clubs was evaluated. The following four items (a), (b), (c) and (d) were used as evaluation items. Each of the golf players evaluated each of the golf clubs in 5 stages of one point to five points for each of the items. Higher evaluation points mean better evaluations. The average value of the evaluation points is shown in the following Table 1. The total of the average point of four evaluation items is shown in the following Table 1 as "overall evaluation".

(a) Loudness of sound
(b) Pitch of sound
(c) Resonance
(d) Preference

[Evaluation of Durability]

The golf club of each of Examples was mounted to a swing robot and made to hit golf balls at a head speed of 50 m/s. The hitting point was set to a sweet spot position. The test was completed when cracks were created on the head. The number of hittings until cracks were created on the head is shown in the following Table 1.

TABLE 1

Specifications and evaluation results of Examples and Comparative examples

| | Example 1 | Example 2 | Example 3 | Comparative Example 1 | Comparative Example 2 |
|---|---|---|---|---|---|
| Head volume (cc) | 460 | 460 | 460 | 460 | 460 |
| Head weight (g) | 185 | 187 | 187 | 190 | 190 |
| θ a (degree) | 30 | 30 | 20 | 0 | 0 |
| θ 1 (degree) | 0 | −5 | 10 | 0 | 90 |

TABLE 1-continued

Specifications and evaluation results of Examples and Comparative examples

| | | Example 1 | Example 2 | Example 3 | Comparative Example 1 | Comparative Example 2 |
|---|---|---|---|---|---|---|
| θ 2 (degree) | | 30 | 25 | 30 | 0 | 90 |
| Lk11 (mm) | | 90 | 90 | 90 | 90 | — |
| Lk12 (mm) | | 60 | 60 | 60 | 60 | — |
| Length of outer side groove forming parts (mm) | | — | — | — | — | 60 |
| Length of inner side groove forming parts (mm) | | — | — | — | — | 90 |
| D1 (mm) | | 0.5 | 0.5 | 0.5 | 0.5 | 0.5 |
| H1 (mm) | | 0.6 | 0.6 | 0.6 | 0.6 | 0.6 |
| Evaluation of hitting sound | Loudness of sound | 4.0 | 4.4 | 4.7 | 3.9 | 3.3 |
| | Pitch of sound | 4.3 | 4.2 | 4.7 | 4.2 | 3.5 |
| | Resonance | 4.0 | 4.1 | 4.5 | 3.4 | 3.0 |
| | Preference | 3.8 | 4.3 | 4.8 | 4.0 | 3.1 |
| | Overall evaluation | 16.1 | 17.0 | 18.7 | 15.5 | 12.9 |
| Evaluation of durability | | 11627 | 13867 | 16482 | 9411 | 8476 |

As shown in Table 1, Examples have higher evaluation than those of Comparative Examples. Advantages of the present invention are clearly indicated by these results of evaluation.

The present invention is applicable to all types of golf club heads such as wood type golf club heads, utility type heads (hybrid type heads) and iron type golf club heads or the like.

The description hereinabove is merely for an illustrative example, and various modifications can be made in the scope not to depart from the principles of the present invention.

What is claimed is:

1. A hollow golf club head comprising:

a sole part, wherein the sole part has a first groove forming part and a second groove forming part which have a recessed outer surface and a protruding inner surface;

the first groove forming part and the second groove forming part have a front-back directional length; and a distance between the first groove forming part and the second groove forming part in a toe-heel direction increases in a direction toward a back of the head;

the sole part further comprising:

a plurality of sets of the first groove forming part and the second groove forming part, wherein the sole part is absent of any other groove forming parts between the first groove forming part and the second groove forming part of a first set of the plurality of sets, and wherein the sole part is absent of any other groove forming parts between the first groove forming part and the second groove forming part of a second set of the plurality of sets.

2. The golf club head according to claim 1, wherein the first groove forming part and the second groove forming part of each of the first and second sets exist on a back of a face surface.

3. The golf club head according to claim 1, wherein the sole part has a connecting groove part formed by connecting a front end of the first groove forming part and a front end of the second groove forming part of each of the first and second sets with each other.

4. The golf club head according to claim 3, wherein a length Lr of the connecting groove part in each of the first and second sets is 100 mm or greater and 200 mm or less.

5. The golf club head according to claim 1, wherein the sole part has a first connecting groove part formed by connecting a front end of the first groove forming part and a front end of the second groove forming part of the first set of the plurality of sets with each other, a second connecting groove part formed by connecting a front end of the first groove forming part and a front end of the second groove forming part of the second set of the plurality of sets with each other;

wherein the first connecting groove part is provided on a toe side relative to a center section plane of the head; and the second connecting groove part is provided on a heel side relative to the center section plane of the head.

6. The golf club head according to claim 1, wherein a ratio [ta/tb] of a thickness ta (mm) of the groove forming parts in each of the first and second sets to an average thickness tb (mm) of the sole part excluding the groove forming parts is 1.0 or greater and 2.0 or less.

7. The golf club head according to claim 1, wherein an angle θa between an extending direction of the first groove forming part and an extending direction of the second groove forming part adjacent to the first groove forming part in each of the first and second sets is 5 degrees or greater and 60 degrees or less.

8. The golf club head according to claim 1, wherein an angle θt between the groove forming part in each of the first and second sets located closest to a toe side and a front-back direction is 10 degrees or greater and 60 degrees or less; and an angle θh between the groove forming part in each of the first and second sets located closest to a heel side and the front-back direction is 10 degrees or greater and 60 degrees or less.

9. The golf club head according to claim 1, wherein an absolute value of an angle θ1 between an extending direction of the groove forming part in each of the first and second sets nearest to a center section plane and a front-back direction is 5 degrees or greater and 30 degrees or less.

10. The golf club head according to claim 1, wherein an angle θ2 between an extending direction of the groove forming part in each of the first and second sets farthest from a center section plane and a front-back direction is 10 degrees or greater and 60 degrees or less.

11. The golf club head according to claim 1, wherein an angle θ3 between an extending direction of the groove forming part in each of the first and second sets located closest to a toe side and an extending direction of the groove forming part located closest to a heel side is 20 degrees or greater 120 degrees or less.

12. The golf club head according to claim 1, wherein a straight line Lx connects a point on the groove forming part in each of the first and second sets located closest to a front and a point on the groove forming part located closest to a back with each other; and a ratio [m1/L1] of a maximum distance m1 (mm) between a point existing on the groove fonning part and the straight line Lx to a length L1 (mm) of the straight line Lx is equal to or less than 0.5.

13. The golf club head according to claim 1, wherein a height H1 (mm) of a protruding part on an inner surface side of the groove forming parts in each of the first and second sets is 0.1 mm or greater and 3 mm or less.

14. The golf club head according to claim 1, wherein a difference (H1−D1) between a height H1 (mm) of a protruding parts on an inner surface side of the groove forming parts in each of the first and second sets and a groove depth D1 (mm) on an outer surface side of the groove forming part is 0.1 mm or greater and 2 mm or less.

15. The golf club head according to claim 1, wherein a groove Mt other than the groove forming parts in each of the first and second sets is formed on the sole part; and the groove Mt and the groove forming parts in each of the first and second sets are not crossed with each other.

16. The golf club head according to claim 1, wherein a length Lk1 of the groove forming parts in each of the first and second sets is 30 mm or greater and 150 mm or less.

17. The golf club head according to claim 1, wherein a difference [Lk11−Lk12] between a length Lk11 (mm) of the groove forming parts in each of the first and second sets nearest to a center section plane on a toe side relative to the center section plane and a length Lk12 (mm) of the groove forming parts in each of the first and second sets farthest from the center section plane on the toe side relative to the center section plane is 5 mm or greater and 80 mm or less.

18. The golf club head according to claim 1, wherein a difference [Lk11−Lk12] between a length Lk11 (mm) of the groove forming part in each of the first and second sets nearest to a center section plane on a heel side relative to the center section plane and a length Lk12 (mm) of the groove forming part in each of the first and second sets farthest from the center section plane on the heel side relative to the center section plane is 5 mm or greater and 80 mm or less.

19. The golf club head according to claim 1, wherein a volume of the head is 350 cc or greater and 460 cc or less.

20. The golf club head according to claim 1, wherein a weight of the head is 170 g or greater and 220 g or less.

* * * * *